US005193840A

United States Patent [19]

Spitaler et al.

[11] Patent Number: 5,193,840

[45] Date of Patent: Mar. 16, 1993

[54] SKI BINDING FOR A CROSS COUNTRY SKI OR TOURING SKI

[75] Inventors: Engelbert Spitaler, Wr. Neudorf; Heinz Wittman, Vienna; Roland Erdei, Weigelsdorf, all of Austria

[73] Assignee: HTM Sport- und Freizeitgeraete Gesellschaft m.b.H., Schwechat, Austria

[21] Appl. No.: 777,280

[22] PCT Filed: Mar. 13, 1991

[86] PCT No.: PCT/EP91/00471

§ 371 Date: Nov. 27, 1991

§ 102(e) Date: Nov. 27, 1991

[87] PCT Pub. No.: WO91/15274

PCT Pub. Date: Oct. 17, 1991

[30] Foreign Application Priority Data

Mar. 30, 1990 [AT] Austria ..... 746/90

[51] Int. Cl.[5] ..... A63C 9/18

[52] U.S. Cl. ..... 280/615; 280/632

[58] Field of Search ..... 280/614, 615, 631, 632, 280/633, 634, 611, 628

[56] References Cited

U.S. PATENT DOCUMENTS

| | | | |
|---|---|---|---|
| 4,722,613 | 2/1988 | Jungkind | 280/632 X |
| 4,909,532 | 3/1990 | Provence et al. | 280/615 |
| 4,917,399 | 4/1990 | Holzl | 280/615 |

FOREIGN PATENT DOCUMENTS

| | | | |
|---|---|---|---|
| 0176951 | 4/1986 | European Pat. Off. | 280/615 |
| 0183000 | 6/1986 | European Pat. Off. | 280/615 |
| 0254094 | 1/1988 | European Pat. Off. | 280/615 |
| 0381092 | 8/1990 | European Pat. Off. | 280/615 |
| 8703211 | 6/1987 | World Int. Prop. O. | 280/615 |
| 9000918 | 2/1990 | World Int. Prop. O. | 280/615 |

*Primary Examiner*—Brian Johnson

*Attorney, Agent, or Firm*—Flynn, Thiel, Boutell & Tanis

[57] ABSTRACT

A ski binding for a cross country ski or touring ski (1). The ski binding includes a swivel part (40) and a holding cup (50) both pivotal about a transversely extending first axle (3) against the force of an elastic element in unison as well as with respect to one another. The swivel part (40) is constructed as a two-arm toggle lever and carries therewith a locking pin (42) on a first lever arm (41) thereof and a second axle (7) for a lock part (60) on a second lever arm (43) thereof. The holding cup (50) has in a front area thereof a crossbar (54) connecting its sidewalls (52), which crossbar is constructed as a locking nose (55) at its front end. The locking nose is defined by a first arcuate surface (56) extending around the transversely extending first axle (3) and a contiguous arcuate holding surface (57). A lock part (60) is provided and includes an arcuate surface region (61) around the second axle (7). When the ski binding is in the closed position, tangential planes tangent to the arcuate holding surface (57) and to the arcuate surface region (61) define an acute angle (α) with one another.

4 Claims, 3 Drawing Sheets

SKI BINDING FOR A CROSS COUNTRY SKI OR TOURING SKI

The invention relates to a ski binding for a cross country ski or touring ski.

BACKGROUND OF THE INVENTION

Such a ski binding is described in the WO 87/03211 (corresponding to U.S. Pat. No. 4,993,742) The sidewalls of the holding cup are connected by a crossbar in this known ski binding, which crossbar has a locking groove. The swivel part, which is pivotal with a holding cup about a common transversely extending axle carries on its upwardly directed extension an axle to which a lock part with a locking nose is hinged. The locking nose extends into the locking groove of the crossbar of the holding cup when the ski binding is closed. Such a cross country ski binding with the cross country ski boot, which fits the binding, can also be obtained commercially and has proven to be successful in practice.

However, it has been found that the closing of the binding may possibly be difficult when snow, ice or dirt has accumulated or been compacted under the holding cup or under the cross country ski boot during a stepping into the binding. The holding cup is in such a case not completely swung down and the locking nose of the lock cannot fully extend into the locking groove of the holding cup. The locking nose of the lock presses onto the crossbar caused by the force of the locking spring, however, an unintended opening of the ski binding can occur in the case of very strong vibrations.

The purpose of the invention is to improve the known ski binding such that a reliable closing of the same occurs even when snow, ice or dirt accumulations prevent the complete downward swing of the holding cup. In particular a stepless adjustment of the lock part is thereby desired in case the amount of snow or dirt under the holding cup becomes slowly worn away during skiing. Furthermore, the entire height of the ski binding is less.

SUMMARY OF THE INVENTION

The objects and purposes of the invention have been met by providing a ski binding for a cross country ski or touring ski. The ski binding includes a swivel part and a holding cup both pivotal about a transversely extending first axle against the force of an elastic element in unison as well as with respect to one another. The swivel part is constructed as a two-arm toggle lever and carries therewith a locking pin on a first lever arm thereof and a second axle for a lock part on a second lever arm thereof. The holding cup has in a front area thereof a crossbar connecting its sidewalls, which crossbar is constructed as a locking nose at its front end. The locking nose is defined by a first arcuate surface extending around the transversely extending first axle and a contiguous arcuate holding surface. A lock part is provided and includes an arcuate surface region around the second axle. When the ski binding is in the closed position, tangential planes tangent to the arcuate holding surface and to the arcuate surface region define a forwardly open acute angle $\alpha$ in a range of 1 to 15 degrees (preferably 3 to 10 degrees) with respect to one another.

Due to the face that the holding cup has in its front region a crossbar connecting its sidewalls, which crossbar is constructed as a locking nose having at its front end a first surface extending approximately in the form of a cylindrical sleeve section extending around the transversely extending axle and with a contiguous second surface designed like a further cylindrical sleeve section and extending in direction of the transversely extending axle and operating as a holding surface, that the lock has a locking region arranged around the locking axle along a cylindrical sleeve section, and that, viewed in the closed and not stressed position of the ski binding, the axis of the cylindrical sleeve section forming the holding surface is spaced forwardly from the axle of the cylindrical sleeve section forming the locking region, it is guaranteed that even without a complete downward swinging of the holding cup the locking region of the lock part grips sufficiently far under the holding surface of the locking nose that a reliable closing of the ski binding is assured. The design of the holding surface in the form of a cylindrical sleeve section, with the tangential planes tangent to the holding surface and to the locking region defining an acute angle with one another, enables the stepless moving up of the lock part in closing direction when the accumulation of dirt below the cup becomes less.

BRIEF DESCRIPTION OF THE DRAWINGS

Further advantages, characteristics and details of the invention will be described hereinafter in greater detail in connection with the drawings without being limited to these drawings. In the drawings.

DETAILED DESCRIPTION

Figure 1:
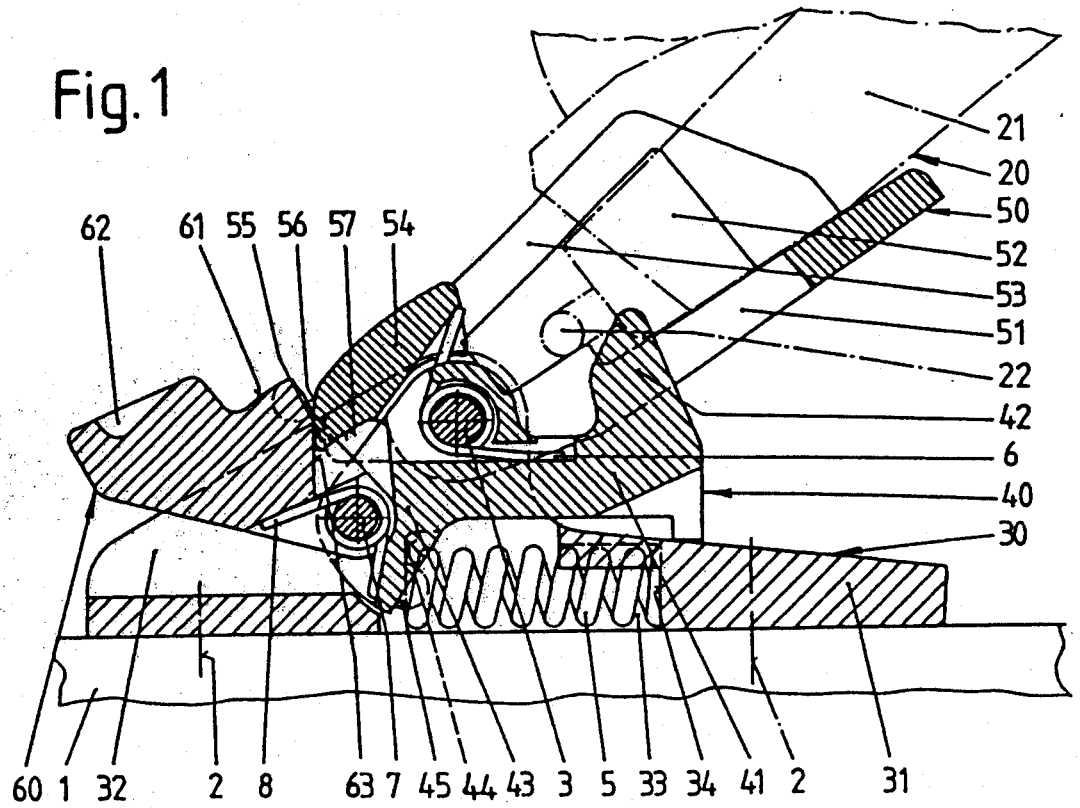
FIG. 1 is a longitudinal cross-sectional view of an embodiment of the cross country ski binding embodying the invention, namely, in a position where it is ready to be stepped into.

The terms front, rear, above, below in the following description are to be understood from the standpoint of the user; namely, front means toward the tip of the ski.

A bearing block 30 is mounted on a ski 1 by means of schematically indicated screws 2. It consists substantially of a base plate 31 and sidewalls 32. The sidewalls 32 support a transversely extending axle 3. A swivel part 40 is hinged to the transversely extending axle 3. The swivel part 40 is designed as a toggle lever, with its first lever arm 41 extending rearwardly and carrying an upwardly directed locking pin 42, while the second lever arm 43 is inclined forwardly and downwardly. The second lever arm 43 has a support surface 44 and a projection 45 for a spring on its downwardly and rearwardly directed side, which spring 5 is arranged in an elongated recess 33 of the base plate 31. The spring 5 is designed as a compression spring in this exemplary embodiment and is supported at one end thereof on the support surface 44 of the swivel part 40 and at the other end on a rear boundary wall 34 of the elongated recess 33.

The transversely extending axle 3 supports furthermore a holding cup 50 to receive a cross country ski boot 20. The holding cup 50 has an opening 51 for the locking pin 42. Guide bars 53 are connected at the top of the sidewalls 52 of the holding cup 50. The sidewalls 52 of the holding cup 50 are connected in their front part by a crossbar 54. The crossbar 54 is designed as a locking nose 55 at its front end, with its first surface 56 extending approximately like a cylindrical sleeve section around the transversely extending axle 3. A second surface or a holding surface 57 follows, which second surface or holding surface is also designed as a cylindrical sleeve section having a radius $r_H$ and extends approximately in direction of the transversely extending axle 3. The exact design and position of the surfaces 56 and 57 and the associated axes can be recognized more clearly in FIG. 4.

An expanding spring 6 is arranged around the transversely extending axle 3 and continually urges the swivel part 40 and the holding cup 50 in opposite directions about the axle.

Figure 4:
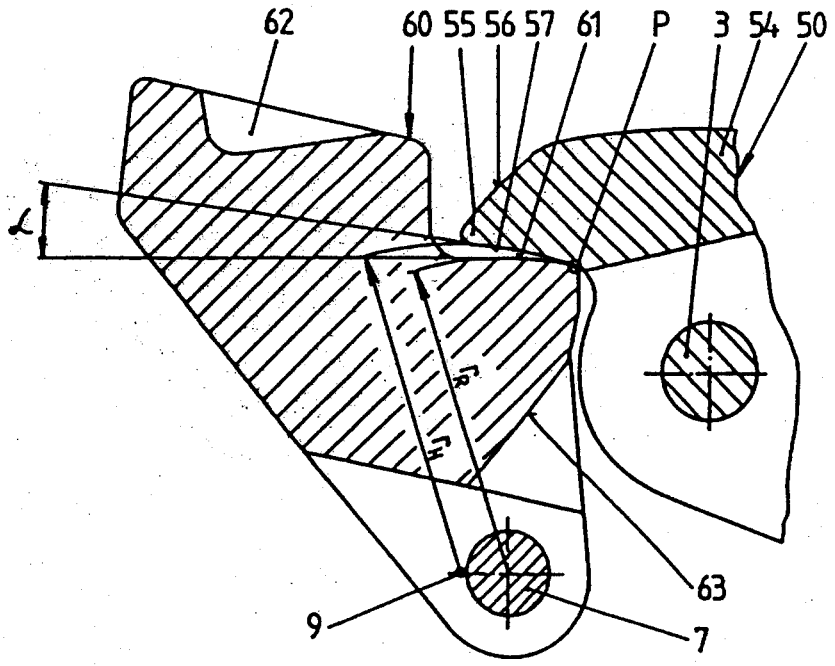
FIGS. 4, 5 and 6 show each a detail of the ski binding of the invention in an enlarged scale.

A locking axle 7 extending transversely with respect to the longitudinal direction of the ski is arranged on the second lever arm 43 of the swivel part 40. The locking axle 7 carries a lock part 60 which has a locking region 61 and a recess 62 thereon. The recess 62 enables the insertion of the tip of a ski pole thereinto for the voluntary opening of the ski binding. The locking region 61 is arranged along a cylindrical sleeve surface having a radius $r_R$, the axis of which coincides with the locking axle 7. FIG. 4 also shows that the axis 9 of the cylindrical sleeve section forming the holding surface 57 lies in front of the locking axle 7 in the sliding position of the ski binding. An unobstructed surface portion 63 is provided below the locking region 61. A locking spring 8 is arranged around the locking axle 7 to continually urge the lock part 60 in a closing direction.

FIG. 1 shows furthermore the front area of the cross country ski boot 20 having a sole 21 and a hook element 22 illustrated by dash-dotted lines in the drawings. This cross country ski boot 20 is known, is not part of the subject matter of this invention and is, therefore, not described in detail.

Figure 2:
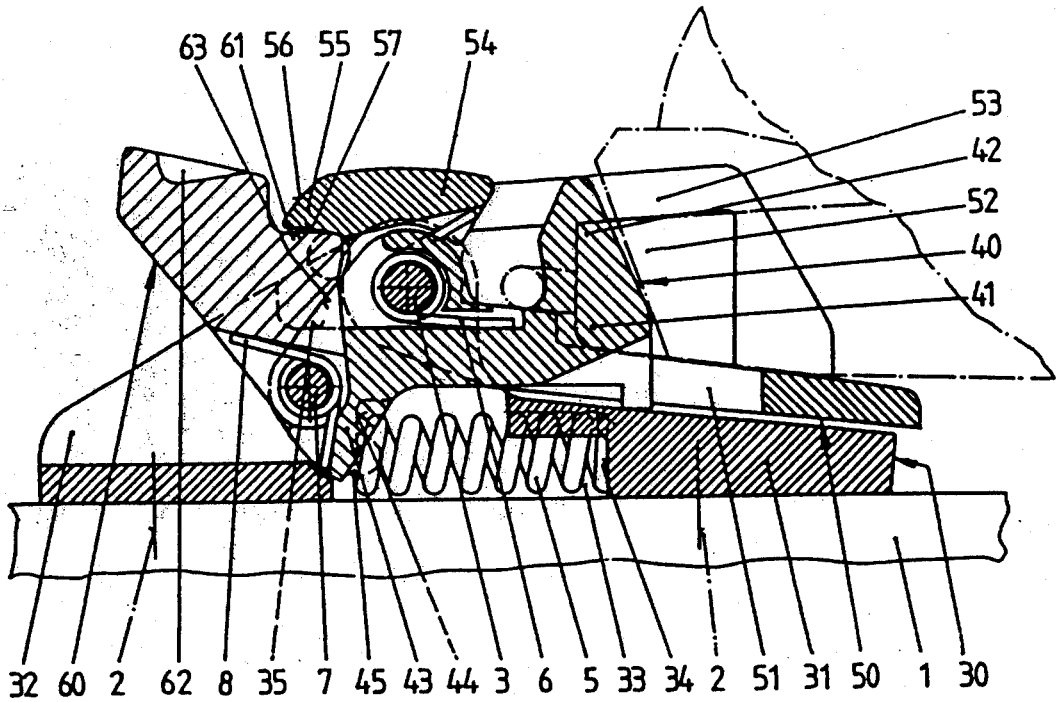
FIG. 2 shows the cross country ski binding of FIG. 1 in the closed, however, not stressed position (sliding position)

FIG. 1 shows the cross country ski binding of the invention ready to be stepped into and with an inserted cross country ski boot 20. The holding cup 50 is, during a lowering of the cross country ski boot 20, swung downwardly against the force of the expanding spring 6, with the locking pin 42 penetrating through the opening 51 in the holding cup 50 and extending into the opening existing between the sole 21 and the hook element 22. The first surface 56 of the locking nose 55 slides at the same time along the surface portion 63 of the lock part and thus makes it possible that the locking spring 8 swings the lock part 60 in the closing direction until the locking region 61 of the lock part 60 engages the holding surface 57 of the holding cup 50. This position is illustrated in FIG. 2. Thus the holding cup 50, the swivel part 40 and the lock 60 form a unit moving with the cross country ski boot 20. FIG. 4 shows that the holding surface 57 and the locking region 61 engage one another at the point P.

Figure 3:
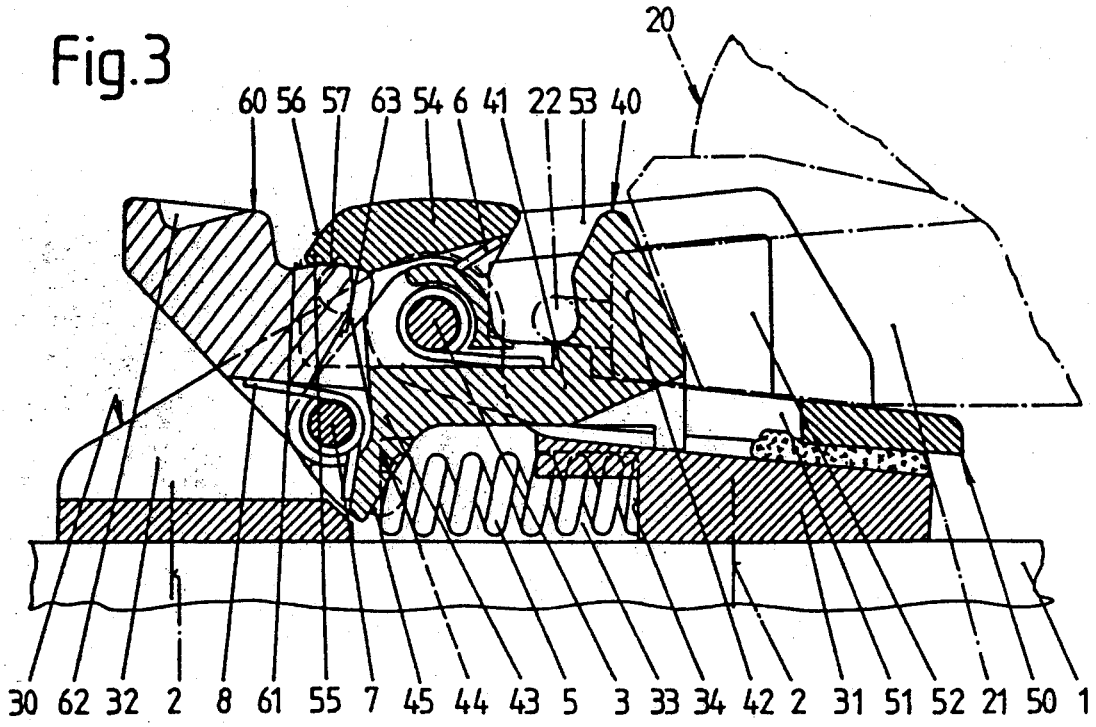
FIG. 3 shows the cross country ski binding of FIG. 2, however, with dirt or ice having accumulated below the cup.
Figure 5:
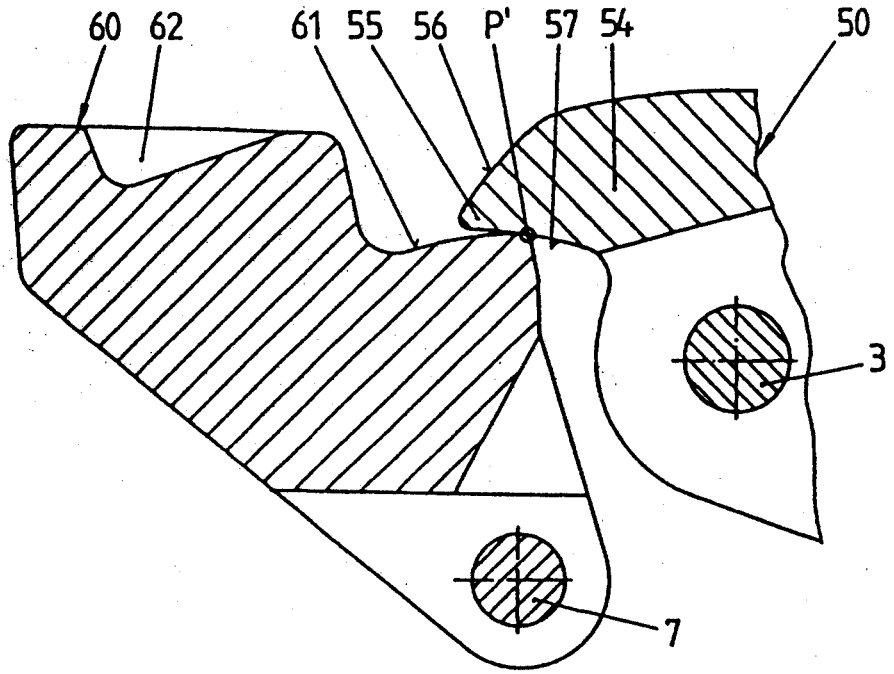

FIG. 3 illustrates a cross country ski binding in the closed position similar to FIG. 2, with packed snow having been collected below the holding cup 50, however, preventing a complete swinging down of the holding cup. FIG. 3 and the associated enlarged illustration according to FIG. 5 show that the locking region 61 of the lock part 60 engages the holding surface 57 of the holding cup 50 at a different point, namely P', than that of the case in the situation illustrated in FIG. 2 and 4, where the holding cup 50 is completely swung down. Of course, depending on the amount of packed snow collected below the holding cup 50, different angles of traverse and thus different points of engagement are possible. The inventive design of the holding surface 57 and of the locking region 61 guarantees, even when the ski binding or the boot sole is rather dirty, that the holding surface 57 still sufficiently grips over the locking region 61. A play-free cooperation between the holding surface 57 and the locking region 61 is thereby assured in every conceivable position. The lock part is automatically moved into a closing direction by the locking spring 8 when the packed snow below the holding cup 50 is slowly worn away during cross country skiing.

Figure 6:
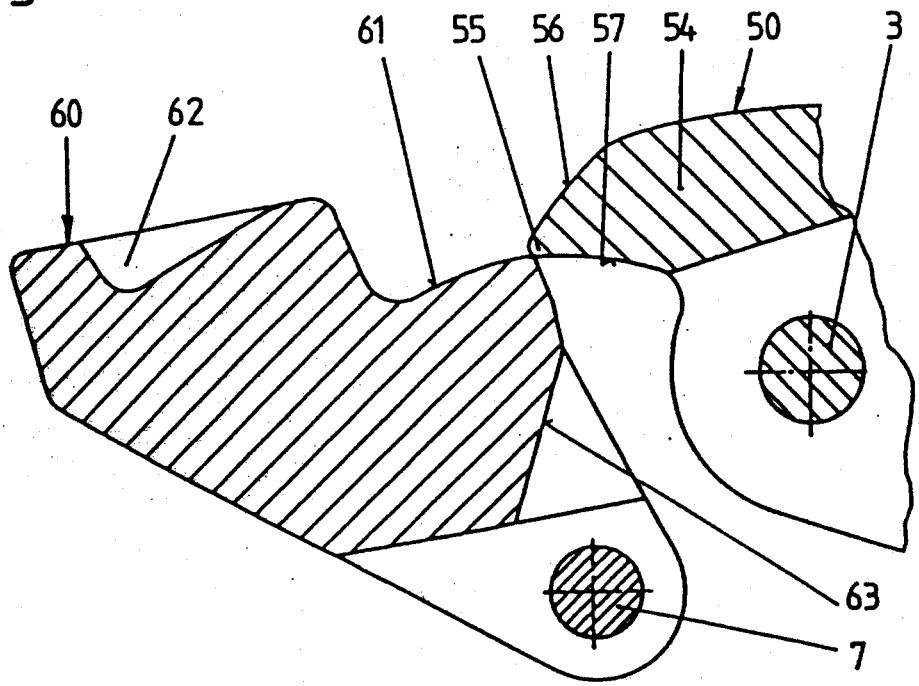

FIG. 6 illustrates the locking region 61 and the locking nose 55 at the point of opening. The ski binding is opened by pivoting the lock part 60, by, for example, pressing the tip of a ski pole into the recess 62 of the lock part 60.

Of course, the invention is not to be limited to the described exemplary embodiment illustrated in the drawings. Rather modifications of the same are possible without departing from the scope of the invention.

The embodiments of the invention in which an exclusive property or privilege is claimed are defined as follows:

1. A ski binding for a cross country or touring ski comprising a bearing block adapted to be secured to a ski, said bearing block having a horizontally transversely extending first axle thereon, a holding cup and a two-arm swivel part pivotally supported for movement about said horizontally transversely extending first axle in unison as well as with respect to one another for the purpose of transitioning between a closed and an open position of the ski binding, a first lever arm of said swivel part carrying at least one locking pin, said holding cup having means defining an opening for receiving therein said at least one locking pin in the closed position of the ski binding, said locking pin being fixed by a yieldable lock, said holding cup being further adapted to grip over a front sole extension of a ski boot while said locking pin also extends through an opening in an extension of the front sole of the ski boot, whereas in the open position of the ski binding, said locking pin is removed from inside of said opening on said holding cup, an elastic element for resisting said pivoting of said holding cup and said swivel part about said transversely extending first axle, a second lever arm of said swivel part having a second axle thereon, said yieldable lock including a lock part pivotally mounted on said second axle for engaging said holding cup in the closed position of the ski binding and a spring for urging said holding cup and said swivel part apart, wherein said holding cup has a transversely extending crossbar connecting its sidewalls in a front area thereof, wherein said crossbar has at a front facing end thereof a locking nose which has a first arcuate surface extending around said transversely extending first axle and a second arcuate surface contiguous with said first surface and extending generally in a direction of said transversely extending first axle and operating as a holding surface, wherein said lock part has an arcuate surface region arranged around said second axle, and wherein, when said ski binding is in the closed position, planes tangential to said arcuate holding surface and to said arcuate surface region define with one another an arcuate, forwardly open angle ($\alpha$) in a range of 1° to 15°.

2. The ski binding according to claim 1, wherein said holding surface is a sleeve section of a circular cylinder, an axis of which, when the ski binding is in the closed position, lies in front of said second axle.

3. The ski binding according to claim 1, wherein said second lever arm on said swivel part, when the ski binding is in a closed and non-stressed position, extends downwardly and forwardly, and wherein said second axle extends in a horizontal plane oriented below a horizontal plane containing said transversely extending first axle.

4. The ski binding to claim 1, wherein said angle ($\alpha$) is in the range of 30° to 10°.

* * * * *

UNITED STATES PATENT AND TRADEMARK OFFICE

CERTIFICATE OF CORRECTION

PATENT NO. : 5 193 840

DATED : March 16, 1993

INVENTOR(S) : Engelbert SPITALER et al

It is certified that error appears in the above-identified patent and that said Letters Patent is hereby corrected as shown below:

On the title page, item [75] Inventors:
change "Heinz Wittman" to ---Heinz Wittmann---.

Column 4, line 46; delete "inside of".
line 55; delete "connecting its".
line 56; delete "sidewalls".

Column 6, line 5; after "binding" insert ---according---.

Signed and Sealed this
Fourth Day of January, 1994

*Attest:*

*Attesting Officer*

Bruce Lehman

BRUCE LEHMAN

*Commissioner of Patents and Trademarks*